US005752530A

United States Patent [19]

Traintinger

[11] Patent Number: 5,752,530

[45] Date of Patent: May 19, 1998

[54] METHOD OF ATTACHING FOREIGN HAIR TO SCALP HAIR

[76] Inventor: Felix Traintinger, Rosengasse 11, 5020 Salzburg, Austria

[21] Appl. No.: 691,183

[22] Filed: Aug. 1, 1996

[30] Foreign Application Priority Data

Aug. 2, 1995 [EP] European Pat. Off. ..... 95111900

[51] Int. Cl.[6] ..... A41G 5/00

[52] U.S. Cl. ..... 132/201

[58] Field of Search ..... 132/201, 200, 132/53, 54

[56] References Cited

U.S. PATENT DOCUMENTS

| | | | |
|---|---|---|---|
| 3,530,862 | 9/1970 | Hudson | 132/201 |
| 5,107,867 | 4/1992 | Barrington | 132/201 |
| 5,121,761 | 6/1992 | Meister | 132/201 |

FOREIGN PATENT DOCUMENTS

| | | | |
|---|---|---|---|
| 2271057 | 4/1994 | United Kingdom | 132/201 |

*Primary Examiner*—Jeffrey A. Smith
*Attorney, Agent, or Firm*—Herbert L. Lerner; Laurence A. Greenberg; Werner H. Stemer

[57] ABSTRACT

Foreign hair is attached to naturally grown scalp hair. First, a strand of scalp hair is combined with a strand of foreign hair. A clamping sleeve is slipped onto the loop of a loop catcher. Then the combined strand is inserted into loop and it is pulled into and through the clamping sleeve with the loop catcher. The combined strand of scalp hair and foreign hair are then preliminarily attached by pre-squeezing the sleeve. After the sleeve is properly placed in the vicinity of the scalp, the sleeve is finally pressed so as to clamp the foreign hair to the scalp hair. The sleeve, which is preferably of the same color as the hair, may be removed by prying it open with bent-nose pliers provided with the invention.

6 Claims, 2 Drawing Sheets

METHOD OF ATTACHING FOREIGN HAIR TO SCALP HAIR

BACKGROUND OF THE INVENTION

FIELD OF THE INVENTION

The invention relates to a hair attachment system, in particular to a system in which foreign or artificial hair is attached to natural hair.

A wide variety of hair replacement systems have been known in the art. They range from placing a wig to surgically sewing hair into the human scalp. In addition, it has been known heretofore to attach strands of hair to strands of natural hair, so as to lengthen and to thicken the amount of hair.

SUMMARY OF THE INVENTION

It is accordingly an object of the invention to provide a hair replacement system, which overcomes the shortcomings and disadvantages of the heretofore-known devices and methods of this general type and which allows quick and dependable attachment of additional hair to the existing, natural hair.

With the foregoing and other objects in view there is provided, in accordance with the invention, a method of attaching foreign hair to scalp hair, which comprises:

commonly inserting a combined strand of scalp hair and a strand of foreign hair into a metal sleeve;

positioning the metal sleeve on the combined strand and attaching the strand of foreign hair to the strand of scalp hair by squeezing the metal sleeve.

In accordance with an added mode of the invention, there are provided pliers and the attaching step is performed by squeezing the metal sleeve with pliers.

In accordance with an additional mode of the invention, the method further comprises, prior to the inserting step, clamping the strand of foreign hair to the strand of scalp hair with a clamp positioned in the vicinity of the scalp.

In accordance with another mode of the invention, the method further comprises providing a loop catcher and performing the inserting step by pulling the combined strand through the metal sleeve with the loop catcher. Another step comprises slipping the metal sleeve over a loop of a loop catcher, threading the combined strand through the loop of the loop catcher, and performing the inserting step by pulling the combined strand through the metal sleeve with the loop catcher.

Alternatively, there are provided pliers with an embossing stamp including a groove and a complementary stamp and with a flat plier surface, and wherein the attaching step comprises pre-squeezing the metal sleeve on the combined strand by placing the metal sleeve in the groove and deforming the metal sleeve in the groove with the complementary stamp, finally positioning the pre-squeezed metal sleeve relative to the scalp, and subsequently squeezing the metal sleeve with the flat plier surface to permanently attach the strand of foreign hair to the strand of scalp hair.

Other features which are considered as characteristic for the invention are set forth in the appended claims.

The term foreign hair is used herein as meaning natural or synthetic hair which is to be attached to scalp hair. The term scalp hair is used herein as meaning hair which is permanently attached to the scalp, including synthetic and natural hair which has been surgically attached.

Although the invention is illustrated and described herein as embodied in a hair attachment system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
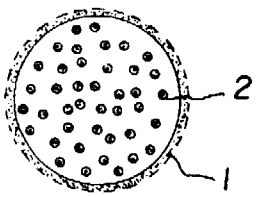
FIG. 1 is a diagrammatic, cross-sectional view through a sleeve according to the invention.
Figure 2:
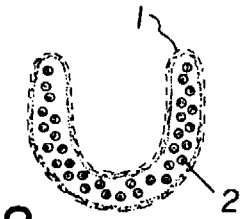
FIG. 2 is a similar view showing a pre-squeezed sleeve.
Figure 3:
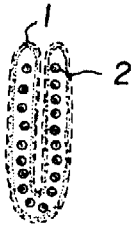
FIG. 3 is a similar view of a finally squeezed sleeve with the hair strands permanently clamped therein.

Referring now to the figures of the drawing in detail and first, particularly, to FIGS. 1–3 thereof, there is seen a substantially cylindrical metal sleeve 1 with strands of hair 2 disposed therein. The preferred embodiment of the sleeve 1 has a length of 7 mm, it has an outer diameter OD=2.5 mm and inner diameter ID=1.9 mm. The sleeve is formed of copper and it is tin-plated or galvanized with an outer layer. Finally, the color of the sleeve is adapted to the color of the hair. For that purpose it is coated with powdered plastic or the like.

After the hair 2, i.e. a strand of natural hair which grows from the scalp and a strand of foreign hair, has been inserted into the sleeve 1, the latter is pre-squeezed into the form of a U or a V (as seen in section) parallel to its longitudinal axis. Pre-squeezing thereby refers to a relatively loose squeeze, so that the hair 2 may still be moved within the sleeve 1. In other words, the condition of the sleeve illustrated in FIG. 2 still allows sliding of the sleeve on the strand of hair 2 so as to obtain placement thereof with the proper spacing from the scalp.

Once the pre-squeezed sleeve 1 has been properly placed, it is pressed flat, as illustrated in FIG. 3. The hair 2 is now clamped within the sleeve 1 and the strand of foreign hair is thus permanently attached to the natural hair.

Figure 4:
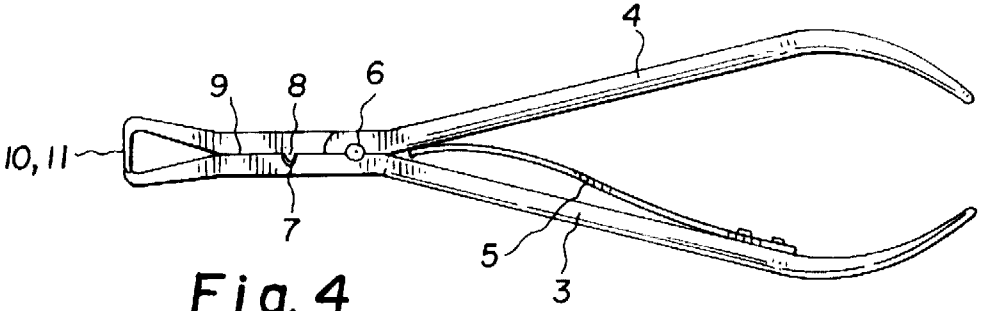
FIG. 4 is a side elevational view of the attachment pliers according to the invention.

Referring now to FIG. 4, the attachment pliers according to the invention are formed with two plier handles 3 and 4, which are biased apart towards the open position by a leaf spring 5. The handles 3, 4 and the spring 5 are made from rust-free steel, such as nirosta steel or niro metal. Forward of a pivot point 6, at which the two plier handles 3 and 4 articulate, there is provided a three-segment operational tip.

A first segment is provided for the pre-squeezing operation (FIG. 2) and comprises a groove 7 formed in the plier handle 3 and a matching stamp 8 formed onto the plier handle 4. The groove 7 and the stamp 8 together form an embossing stamp in the form of a U or V. The spacing between the groove 7 and the stamp 8 is selected so as to cause the relatively loose clamp as it is illustrated in FIG. 2.

A second segment is located forward of the embossing stamp 7, 8. The second segment is a flat plier surface 9 for flattening the sleeve 1 from its pre-squeezed V-shape to its final clamping shape illustrated in FIG. 3.

A third segment is located at the forward-most tip of the pliers, and it is formed by two mutually facing and interengaging noses 10, 11.

Figure 5:
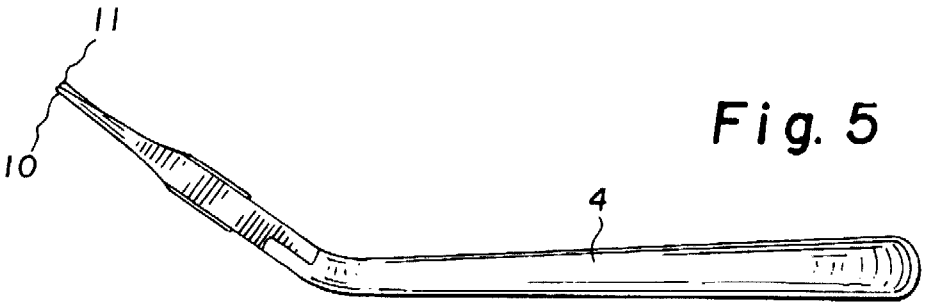
FIG. 5 is a top plan view thereof.

With reference to FIG. 5, the pliers are bent at an angle of approximately 35°, which has been found to be most convenient during the hair attachment operation. The width of the pliers at the first operational segment, i.e. the length of the groove 7 and of the stamp 8, corresponds to the length of the sleeve 1. In the preferred embodiment, the width of the first segement is 8 mm. The ensures that the 7 mm sleeve is squeezed along its entire length.

Figure 6:
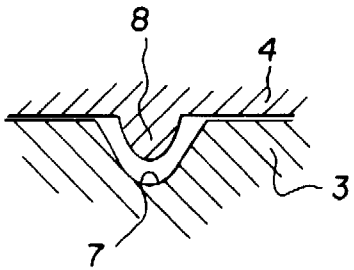
FIG. 6 is a partial longitudinal section through the preliminary squeezing stamp of the clamping pliers.

With reference to FIG. 6, a spacing is provided between the groove 7 and the stamp 8. The spacing is adjusted in accordance with the thickness of the sleeve 1 and the desired degree of clamping following the pre-squeezing operation. In the preferred embodiment, the spacing is 0.65 mm.

Figure 7:
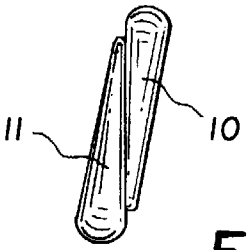
FIG. 7 is a front elevational view showing the noses of the pliers.

With reference to FIG. 7, the noses 10 and 11 are formed so as to abut one another when the pliers are closed over a length of approximately 7 mm. The noses 10 and 11 are used to undo the clamping connection (FIG. 3) and, accordingly, they each reach fully into the 7 mm long sleeve to pry the sleeve open and to release the clamped sleeve.

Figure 8:
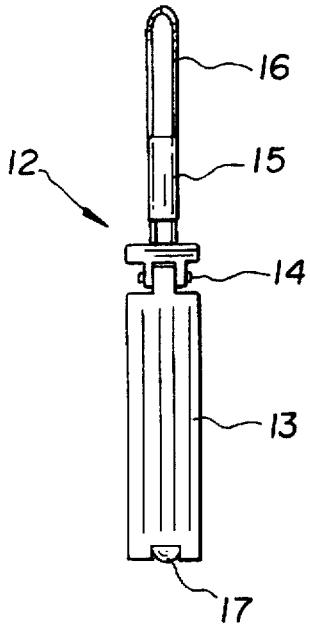
FIG. 8 is a plan view of a hair clamp.

With reference to FIG. 8, a hair clamp 12 includes a flat base part 13 formed of metal or plastic. Forward of a pivot joint 14, there is provided a protective silicone sleeve 15 which is slipped onto a steel wire loop 16. The loop 16, when it is folded back onto the flat base part 13, hooks into a projection 17 formed thereon distally of the pivot joint 14. As will become clear from the following functional description, the hair clamp 12 is used to temporarily attach a strand of foreign hair to natural scalp hair prior to slipping the sleeve 1 onto those strands.

Figure 9:
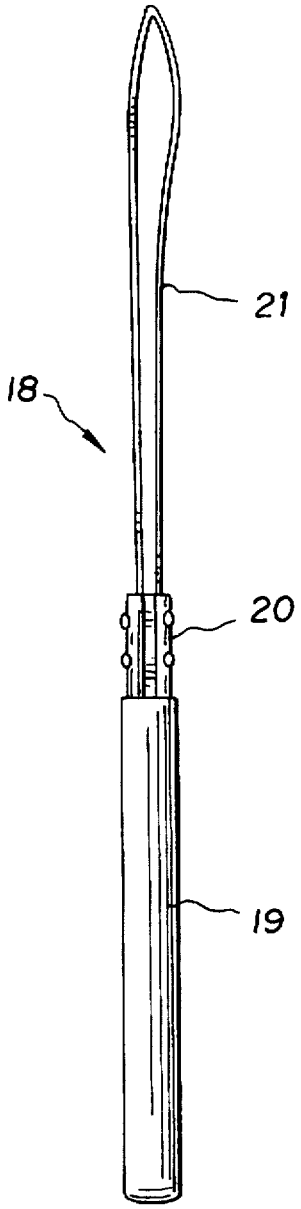
FIG. 9 is a plan view of a loop catcher according to the invention.

With reference to FIG. 9, a loop catcher 18 is formed with a plastic handle 19 and a clamping screw connector 20 or clamp 20 at which the free ends of a loop 21 of steel wire are attached. It is possible to adjust a length of the loop 21 at the clamp 20. The handle 19 is either hollow or partially hollow for receiving therein the free ends of the loop wire.

The method according to the invention may be described as follows: As an introductory step, the naturally grown hair on the scalp is divided and held in the divided condition with conventional clamps and the like. A naturally grown strand of hair is picked up (or separated out) and it is clamped with the clamp 12 close to the scalp together with a foreign strand of hair or an extension or similar attachment. The combined strand (scalp hair and attachment strand) are then inserted into the loop 21 and pulled through a sleeve 1. At this point, the sleeve 1 (with the combined strand in it) is laid into the groove 7 of the pliers and it is pre-squeezed into the V or U shape of FIG. 2. At this point the combined strand is preliminarily fixed and the clamp 12 is removed. At this time it is still possible to readjust the position of the sleeve 1 by sliding it closer towards or farther away from the scalp. When the final position has been found, the sleeve 1 is finally squeezed at the flat plier segment 9.

The connection may be undone by prying the clamped sleeve (FIG. 3) open with the noses 10 and 11.

I claim:

1. A method of attaching foreign hair to scalp hair, which comprises:

clamping a strand of foreign hair to a strand of scalp hair with a clamp positioned in the vicinity of a scalp to which the scalp hair is attached;

commonly inserting a combined strand of the scalp hair and the foreign hair into a metal sleeve;

positioning the metal sleeve on the combined strand and attaching the strand of foreign hair to the strand of scalp hair by squeezing the metal sleeve and collapsing the metal sleeve directly onto the foreign hair and onto the scalp hair.

2. The method according to claim 1, which further comprises providing pliers and performing the attaching step by squeezing the metal sleeve with pliers.

3. The method according to claim 1, which further comprises providing a loop catcher and performing the inserting step by pulling the combined strand through the metal sleeve with the loop catcher.

4. The method according to claim 1, which further comprises slipping the metal sleeve over a loop of a loop catcher, threading the combined strand through the loop of the loop catcher, and performing the inserting step by pulling the combined strand through the metal sleeve with the loop catcher.

5. A method of attaching foreign hair to scalp hair, which comprises:

commonly inserting a combined strand of scalp hair and a strand of foreign hair into a metal sleeve;

positioning the metal sleeve on the combined strand and attaching the strand of foreign hair to the strand of scalp hair by squeezing the metal sleeve, wherein the attaching step comprises pre-squeezing the metal sleeve on the combined strand with pliers, finally positioning the pre-squeezed metal sleeve relative to the scalp, and subsequently squeezing the metal sleeve to permanently attach the stand of foreign hair to the strand of scalp hair.

6. A method of attaching foreign hair to scalp hair, which comprises:

commonly inserting a combined strand of scalp hair and a strand of foreign hair into a metal sleeve;

positioning the metal sleeve on the combined strand and attaching the strand of foreign hair to the strand of scalp hair by squeezing the metal sleeve providing pliers with an embossing stamp including a groove and a complementary stamp and with a flat plier surface, and wherein the attaching step comprises pre-squeezing the metal sleeve on the combined strand by placing the metal sleeve in the groove and deforming the metal sleeve in the groove with the complementary stamp, finally positioning the pre-squeezed metal sleeve relative to the scalp, and subsequently squeezing the metal sleeve with the flat plier surface to permanently attach the stand of foreign hair to the stand of scalp hair.

* * * * *